US011148275B2

(12) United States Patent
Herr et al.

(10) Patent No.: US 11,148,275 B2
(45) Date of Patent: Oct. 19, 2021

(54) HAND-HELD POWER-TOOL DEVICE

(71) Applicant: Robert Bosch GmbH, Stuttgart (DE)

(72) Inventors: Tobias Herr, Stuttgart (DE); Dietmar Saur, Moessingen (DE); Jens Blum, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 371 days.

(21) Appl. No.: 16/316,835

(22) PCT Filed: Jul. 11, 2017

(86) PCT No.: PCT/EP2017/067398

§ 371 (c)(1),
(2) Date: Jan. 10, 2019

(87) PCT Pub. No.: WO2018/011203

PCT Pub. Date: Jan. 18, 2018

(65) Prior Publication Data

US 2019/0291259 A1 Sep. 26, 2019

(30) Foreign Application Priority Data

Jul. 11, 2016 (DE) ..... 102016212607.5
Jul. 10, 2017 (DE) ..... 102017211772.9

(51) Int. Cl.
*B25F 5/00* (2006.01)
*B25B 21/02* (2006.01)
(Continued)

(52) U.S. Cl.
CPC ..... *B25F 5/001* (2013.01); *B25B 21/00* (2013.01); *B25B 21/02* (2013.01); *B25F 5/00* (2013.01); *B25F 5/02* (2013.01)

(58) Field of Classification Search
CPC ..... B25B 21/00; B25B 21/02; B25B 21/008; B25F 5/00; B25F 5/02
(Continued)

(56) References Cited

U.S. PATENT DOCUMENTS 2,662,434 A * 12/1953 Burkhardt ..... B25B 21/02 173/93.6
5,136,197 A 8/1992 Hallett
(Continued)

FOREIGN PATENT DOCUMENTS

CN 206200848 U 5/2017
DE 4239799 A1 6/1993
(Continued)

OTHER PUBLICATIONS

International Search Report for PCT/EP2017/067398; dated Sep. 27, 2017.
(Continued)

*Primary Examiner* — Scott A Smith
(74) *Attorney, Agent, or Firm* — Norton Rose Fulbright US LLP; Gerard A. Messina

(57) ABSTRACT

A handheld power-tool device is described as including a drive unit, which includes at least one driveshaft, and at least one rotary striking mechanism, which includes at least one intermediate shaft aligned at least essentially flush with respect to the driveshaft, and at least one bearing for mounting the driveshaft. It is provided that the bearing is situated at least partially in a plane, which intersects the intermediate shaft and extends at least essentially perpendicularly with respect to the intermediate shaft.

18 Claims, 7 Drawing Sheets

(51) Int. Cl.
*B25B 21/00* (2006.01)
*B25F 5/02* (2006.01)

(58) Field of Classification Search
USPC ... 173/48, 217, 216, 104, 109, 93, 93.5, 178
See application file for complete search history.

(56) References Cited

U.S. PATENT DOCUMENTS 5,361,853 A * 11/1994 Takamura ..... B25B 21/00 173/117
5,897,454 A * 4/1999 Cannaliato ..... B25B 21/008 475/265
7,124,839 B2 * 10/2006 Furuta ..... B25B 21/00 173/104
7,131,503 B2 * 11/2006 Furuta ..... B25B 21/00 173/48
8,627,900 B2 * 1/2014 Oomori ..... H02K 9/06 173/217
8,961,358 B2 * 2/2015 Hirabayashi ..... B25B 21/008 475/298
9,643,300 B2 * 5/2017 Kumagai ..... B25B 21/02
2006/0090913 A1 * 5/2006 Furuta ..... B25B 23/14 173/48
2006/0237205 A1 * 10/2006 Sia ..... B25B 23/1405 173/48
2011/0232930 A1 * 9/2011 Zhang ..... B25B 21/00 173/178
2011/0272172 A1 * 11/2011 Lau ..... B25F 5/02 173/170
2012/0234566 A1 * 9/2012 Mashiko ..... B25F 5/00 173/93.5
2013/0033217 A1 * 2/2013 Hirabayashi ..... B25D 11/106 318/546
2013/0299928 A1 11/2013 Classen et al.
2014/0069675 A1 * 3/2014 Zhang ..... B25B 21/00 173/178
2014/0182869 A1 * 7/2014 Kumagai ..... B25F 5/02 173/93
2015/0041169 A1 * 2/2015 Kumagai ..... B25D 17/26 173/93.7
2015/0352699 A1 12/2015 Sakai et al.

FOREIGN PATENT DOCUMENTS

DE 202016103701 U1 7/2016
EP 0329852 A2 8/1989
EP 1256420 A2 11/2002
EP 23688670 A2 9/2011
JP 2005066804 A 3/2005
JP 2017061005 A 3/2017

OTHER PUBLICATIONS

Hitachi Koki Co., Ltd: Hitachi power tools general catalog, Oct. 2015, pp. 20-21. [no English translation; the catalog entries self-explanatory].

* cited by examiner

HAND-HELD POWER-TOOL DEVICE

BACKGROUND INFORMATION

A hand-held power-tool device including at least one drive unit, which includes at least one driveshaft, and at least one rotary striking mechanism, which includes at least one intermediate shaft aligned at least essentially flush with respect to the driveshaft, and at least one bearing for mounting the driveshaft, has already been provided.

SUMMARY

The present invention is directed to a hand-held power-tool device including at least one drive unit, which includes at least one driveshaft, and at least one rotary striking mechanism, which includes at least one intermediate shaft aligned at least essentially flush with respect to the driveshaft, and at least one bearing for mounting the driveshaft.

It is provided that the bearing be arranged at least partially in a plane, which intersects the intermediate shaft and extends at least essentially perpendicularly with respect to the intermediate shaft.

A "hand-held power-tool device" is to be understood in this context in particular as at least a part, in particular a subassembly, of a hand-held power tool. In particular, the hand-held power-tool device may also encompass the entire hand-held power tool. The hand-held power-tool may be designed as any arbitrary advantageous electrical machine, but advantageously as a rotary impact screwdriver. A "drive unit" is to be understood in particular as a unit which is provided to convert electrical energy in particular into kinetic energy, in particular rotational energy. The drive unit includes in particular at least one housing-free electric motor. The driveshaft is in particular at least partially formed by an armature shaft of the housing-free electric motor. "Provided" is to be understood in particular as specially programmed, designed, and/or equipped. An object being provided for a specific function is to be understood in particular to mean that the object fulfills and/or carries out this specific function in at least one application and/or operating state. A "rotary striking mechanism" is to be understood in this context in particular as a striking mechanism which is provided to convert an at least essentially continuous power delivery of a drive unit into a shock-like angular momentum. The rotary striking mechanism may be designed in particular as a cam rotary striking mechanism or as a V-groove rotary striking mechanism.

In particular, the rotary striking mechanism includes a planetary gear. A "planetary gear" is to be understood in particular as a gearing which includes at least one planet, which is connected to a planet carrier, and is coupled in the radial direction toward the outside to an annulus gear and/or in the radial direction toward to the inside to a sun wheel. The sun wheel, the planet, and/or the annulus gear may be formed in particular by round gear wheels or out-of-center gear wheels which are coordinated. Multiple planetary gears may be connected in succession and/or multiple stages may be interconnected between planetary wheel and annulus gear. An "annulus gear" is to be understood in particular as a gear wheel, which includes a collar designed in the form of a cylinder jacket or in the form of a broken cylinder jacket. Furthermore, the rotary striking mechanism in particular includes a striking mechanism cover. A "striking mechanism cover" is to be understood in this context in particular as a cover element which is provided for at least largely closing the rotary striking mechanism in the direction of at least one further hand-held power tool unit, in particular in the direction of a drive unit. "At least largely" is to be understood in this context as in particular at least by 51%, preferably at least by 65%, and particularly preferably at least by 75%. In particular, the striking mechanism cover has at least one pass-through recess, which is provided for at least partially passing through at least one shaft, in particular a driveshaft. An "intermediate shaft" is to be understood in particular as a shaft of a drivetrain which is situated in particular between a drive unit and an output shaft, in particular of a hand-held power tool. In particular, the at least one intermediate shaft is provided to transmit a force and/or movement, in particular generated by the drive unit, directly and/or indirectly to the output shaft. In particular, the intermediate shaft is at least partially formed as a planet wheel carrier of the planetary gear.

A "bearing" is to be understood in this context in particular as a radial bearing, which is provided for the purpose of rotatably mounting the driveshaft in relation to the intermediate shaft. The term "essentially perpendicularly" is to define here in particular an alignment of a direction in relation to a reference direction, the direction and the reference direction, in particular observed in a plane, enclosing an angle of 90° and the angle having a maximum deviation of in particular less than 8°, advantageously less than 5°, and particularly advantageously less than 2°. In particular in an installed state, the plane intersects both the intermediate shaft and the driveshaft at least essentially perpendicularly. The driveshaft is preferably mounted at least partially inside the intermediate shaft.

A generic hand-held power-tool device having advantageous structural properties may be provided by such a design. In particular, by mounting the driveshaft inside the intermediate shaft, an advantageously compact configuration, in particular an advantageously short overall length of the rotary striking mechanism, may be achieved. A length of the hand-held power-tool device is, for example, at most 200 mm, in particular at most 160 mm, very particularly at most 140 mm, particularly preferably at most 130 mm. The length of the hand-held power-tool device includes in particular the drive unit and the rotary striking mechanism and a tool receptacle.

Furthermore, it is provided that the intermediate shaft includes at least one receptacle recess, which is provided for at least partially accommodating the driveshaft. In particular, the receptacle recess extends along a rotation axis of the intermediate shaft. In particular in an installed state, the driveshaft protrudes at least partially into the intermediate shaft, in particular into the receptacle recess of the intermediate shaft. An advantageously short overall length of the hand-held power-tool device may be achieved in this way.

In particular, the bearing may be designed as a slide bearing and/or an antifriction bearing. The bearing is preferably designed at least partially as an antifriction bearing, for example, as a ball bearing, roller bearing, or needle bearing. The bearing is preferably situated at least partially, advantageously completely, inside the receptacle recess. An advantageously low-friction mounting of the driveshaft may be achieved in this way. Furthermore, an advantageously short overall length of the rotary striking mechanism may be achieved by situating the bearing inside the receptacle recess.

Furthermore, it is provided that the intermediate shaft includes at least one sealing element receptacle. In particular, the sealing element receptacle is situated directly at an insertion opening of the receptacle recess of the intermediate shaft, which is provided for inserting a driveshaft into the intermediate shaft. The sealing element receptacle is provided in particular for at least partially accommodating a sealing element, in particular a sealing ring and/or a shaft sealing ring. In particular, the intermediate shaft includes at least one sealing element situated in the sealing element receptacle. The sealing element is formed in particular as a shaft sealing ring, in particular as a radial shaft sealing ring. The sealing element is provided in particular for at least essentially sealing off the rotary striking mechanism, in particular the planetary gear of the rotary striking mechanism, in relation to the surroundings. An advantageously reliable seal of the rotary striking mechanism may be achieved in this way.

Moreover, a hand-held power tool, in particular a rotary impact screwdriver, including at least one hand-held power-tool device according to the present invention is provided. An advantageously compact hand-held power tool, in particular an advantageously compact rotary impact screwdriver may be provided in this way. In particular, the hand-held power tool may have an advantageously short overall length.

The hand-held power-tool device according to the present invention is not to be restricted in this case to the above-described application and specific embodiment. In particular, the hand-held power-tool device according to the present invention may include a number of individual elements, components, and units, which deviates from a number mentioned herein to fulfill a functionality described herein.

BRIEF DESCRIPTION OF THE DRAWINGS

Further advantages result from the following description of the drawings. Three exemplary embodiments of the present invention are shown in the drawings. The drawings and the description contain numerous features in combination. Those skilled in the art will advantageously also consider the features individually and combine them into reasonable further combinations.

DETAILED DESCRIPTION

Figure 1:
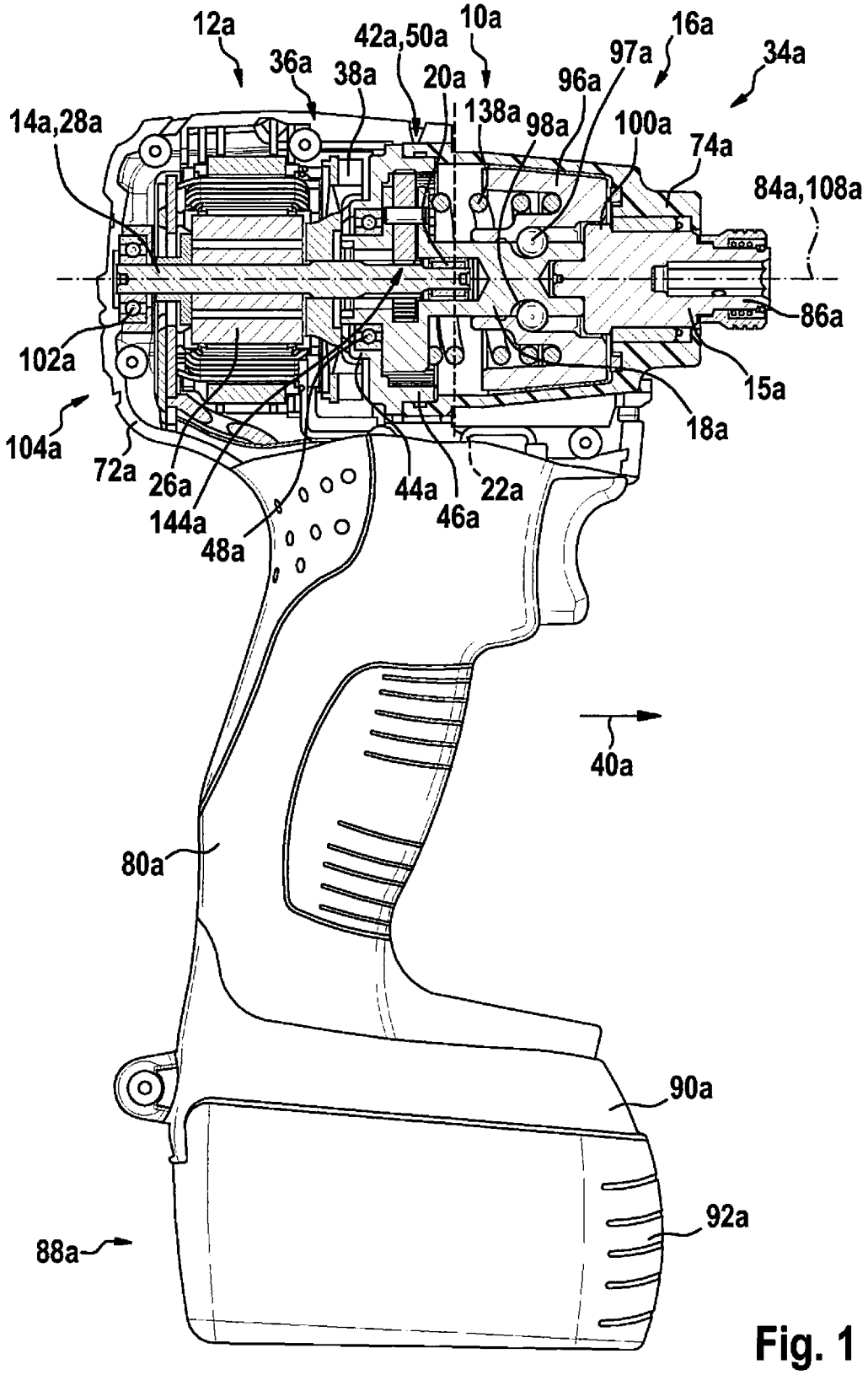
FIG. 1 shows a schematic partial sectional view of a hand-held power tool which is designed as a rotary impact screwdriver.

FIG. 1 shows a hand-held power tool 34*a*, which is designed as a rotary impact screwdriver, in a schematic partial sectional view. Hand-held power tool 34*a* is designed as a battery-powered rotary impact screwdriver. Hand-held power tool 34*a* includes a handle 80*a*, which extends perpendicularly to a rotation axis 84*a* of a tool receptacle 86*a* of hand-held power tool 34*a* provided for accommodating an insert tool (not shown here). Handle 80*a* includes a rechargeable battery holder 90*a* on a side 88*a* facing away from hand-held power tool 34*a*. Rechargeable battery holder 90*a* is provided for accommodating a rechargeable battery unit 92*a* for the power supply of hand-held power tool 34*a*.

Figure 2:
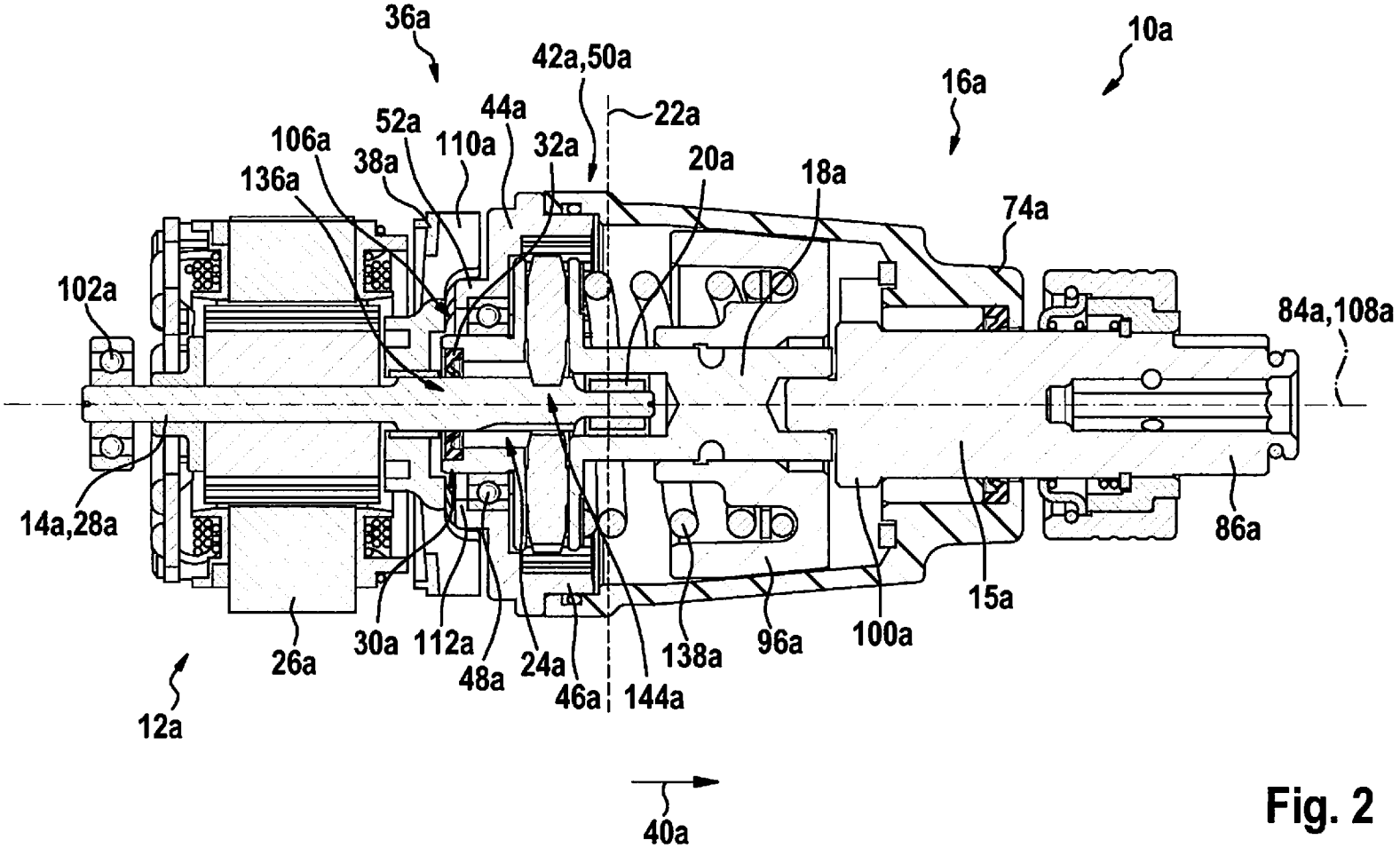
FIG. 2 shows a sectional view of a hand-held power-tool device of the hand-held power tool including a drive unit and a rotary striking mechanism.

Furthermore, hand-held power tool 34*a* includes a hand-held power-tool device 10*a* including a drive unit 12*a* and a rotary striking mechanism 16*a*. FIG. 2 shows handheld power-tool device 10*a* in a sectional view. Hand-held power-tool device 10*a* includes a drive housing 72*a* and a striking mechanism housing 74*a* (cf. FIG. 1). Drive housing 72*a* encloses drive unit 12*a* at least essentially completely. Striking mechanism housing 74*a* encloses rotary striking mechanism 16*a* at least essentially completely (cf. FIG. 1). Drive unit 12*a* is designed as an electrical drive unit, which is supplied with electrical energy with the aid of rechargeable battery unit 92*a*. Drive unit 12*a* includes a housing-free electric motor 26*a*, which is provided for converting the electrical energy provided by rechargeable battery unit 92*a* into rotational energy. Electric motor 26*a* is designed as an open-frame motor, in which components of electric motor 26*a* are mounted individually in drive housing 72*a*. Furthermore, drive unit 12*a* includes a driveshaft 14*a*, which is provided for transmitting the rotational energy to rotary striking mechanism 16*a*. Driveshaft 14*a* is completely formed by an armature shaft 28*a* of housing-free electric motor 26*a*. Armature shaft 28*a* is formed in one piece. Rotary striking mechanism 16*a* is designed as a V-groove rotary striking mechanism. Rotary striking mechanism 16*a* is provided for converting a continuous power delivery of drive unit 12*a* into a shock-like angular momentum. The power of drive unit 12*a* is relayed to the insert tool by an impact of a striker 96*a* of rotary striking mechanism 16*a* on a corresponding anvil 100*a* of an output spindle 15*a* with the aid of a pulse of high power intensity. Anvil 100*a* is formed in one piece with output spindle 15*a* and tool receptacle 86*a* in the illustrated specific embodiment. Striker 96*a* is mounted in such a way that an axial movement and a radial movement are possible. The axial movement is controlled by V-shaped grooves 98*a* (cf. FIG. 3) and driving balls 97*a* (cf. FIG. 1). A spring 138*a* ensures the restoring movement of striker 96*a*.

Rotary striking mechanism 16*a* includes an intermediate shaft 18*a*, which is oriented at least essentially flush with respect to driveshaft 14*a*. Furthermore, hand-held power-tool device 10*a* includes at least one bearing 20*a* for mounting driveshaft 14*a*. Bearing 20*a* is situated at least partially in a plane 22*a*, which intersects intermediate shaft 18*a* and proceeds at least essentially perpendicular with respect to intermediate shaft 18*a*. Driveshaft 14*a* is at least partially mounted inside intermediate shaft 18*a*. Intermediate shaft 18*a* includes a receptacle recess 24*a*, which is provided for at least partially accommodating driveshaft 14*a*. Receptacle recess 24*a* extends at least essentially along a rotation axis 108*a* of intermediate shaft 18*a*. Driveshaft 14*a* protrudes at least partially into intermediate shaft 18*a*, in particular into receptacle recess 24*a* of intermediate shaft 18*a*, in an installed state. Bearing 20*a* for mounting driveshaft 14*a* is situated inside receptacle recess 24*a*. Bearing 20*a* for mounting driveshaft 14*a* is designed as an antifriction bearing. Intermediate shaft 18*a* furthermore includes a sealing element receptacle 30*a*. Sealing element receptacle 30*a* is situated directly at an insertion opening 136*a* of receptacle recess 24*a* of intermediate shaft 18*a*, which is provided for inserting driveshaft 14*a* into intermediate shaft 18*a*. Moreover, intermediate shaft 18*a* includes at least one sealing element 32*a* situated in sealing element receptacle

30*a*. Sealing element 32*a* is designed as a shaft sealing ring, in particular as a radial shaft sealing ring, which is situated in the installed state between driveshaft 14*a* and intermediate shaft 18*a*. Sealing element receptacle 30*a* is designed as a shaft sealing ring receptacle. A further bearing 102*a* for mounting driveshaft 14*a* is situated in drive housing 72*a* on a side 104*a* of electric motor 26*a* facing away from tool receptacle 86*a*.

Moreover, hand-held power-tool device 10*a* includes a cooling air unit 36*a*, which includes at least one fan wheel 38*a* situated between drive unit 12*a* and rotary striking mechanism 16*a*. Fan wheel 38*a* is provided in particular for generating a cooling airflow for cooling rotary striking mechanism 16*a* and/or drive unit 12*a*. Fan wheel 38*a* is rotatably fixedly situated on driveshaft 14*a* of drive unit 12*a*. Drive unit 12*a* is provided for setting fan wheel 38*a* into a rotational movement during operation of hand-held power tool 34*a*. Fan wheel 38*a* and rotary striking mechanism 16*a* overlap at least partially in axial direction 40*a*. Preferably, fan wheel 38*a* at least partially projects beyond rotary striking mechanism 16*a* in axial direction 40*a*. Fan wheel 38*a* has a plurality of fan wheel blades 110*a* situated in the circumferential direction, which overlap at least a part of rotary striking mechanism 16*a* in the circumferential direction. Fan wheel blades 110*a* extend at least essentially in axial direction 40*a*. Rotary striking mechanism 16*a* includes at least one gearing unit 42*a* designed as a single-stage planetary gear 50*a*. Bearing 20*a* for mounting driveshaft 14*a* is situated on a side of planetary gear 50*a* facing away from drive unit 12*a*. A toothing 144*a* between driveshaft 14*a* and planetary gear 50*a* is situated between bearing 20*a* and bearing 102*a*. Alternatively, gearing unit 42*a* may be designed as a multistage planetary gear. Fan wheel 38*a* and at least gearing unit 42*a* preferably at least partially overlap in axial direction 40*a*. Planetary gear 50*a* includes at least one annulus gear 46*a*. Furthermore, rotary striking mechanism 16*a* includes a striking mechanism cover 44*a*. Striking mechanism cover 44*a* is situated between drive unit 12*a* and planetary gear 50*a*. In particular, striking mechanism cover 44*a* is provided for closing at least a large part of rotary striking mechanism 16*a* in the direction of drive unit 12*a*. Striking mechanism cover 44*a* includes a pass-through recess 106*a*, which is provided for at least partially passing through at least driveshaft 14*a*. Striking mechanism cover 44*a* is formed in one piece with annulus gear 46*a*. Striking mechanism cover 44*a* and annulus gear 46*a* at least essentially are made of a metallic material, in particular of a metallic sintering material. Fan wheel 38*a* and at least striking mechanism cover 44*a* preferably at least partially overlap in axial direction 40*a*.

Hand-held power-tool device 10*a* furthermore includes an intermediate shaft bearing 48*a* for mounting intermediate shaft 18*a*. Intermediate shaft bearing 48*a* is designed as an antifriction bearing. Alternatively, intermediate shaft bearing 48*a* may be designed as a slide bearing. Intermediate shaft bearing 48*a* is designed as a radial bearing, which is provided for rotatably mounting intermediate shaft 18*a* in striking mechanism cover 44*a*. Intermediate shaft bearing 48*a* is situated at least partially inside a striking mechanism cover 44*a* of rotary striking mechanism 16*a*. Intermediate shaft bearing 48*a* is situated directly at pass-through recess 106*a* of striking mechanism cover 44*a*. Intermediate shaft bearing 48*a* is situated on the side of striking mechanism cover 44*a* facing toward tool receptacle 86*a*. Striking mechanism cover 44*a* includes at least one bearing receptacle 52*a*, which is provided for accommodating intermediate shaft bearing 48*a*. Bearing receptacle 52*a* is formed in one piece with striking mechanism cover 44*a*. Bearing receptacle 52*a* is situated in the area of pass-through recess 106*a* of striking mechanism cover 44*a*. Bearing receptacle 52*a* is at least essentially hollow-cylindrical. Bearing receptacle 52*a* has an at least essentially ring-shaped stop element 112*a* for intermediate shaft bearing 48*a* on an end facing away from striking mechanism cover 44*a*. Stop element 112*a* is formed in one piece with bearing receptacle 52*a*. An internal diameter of bearing receptacle 52*a* at least essentially corresponds to an external diameter of intermediate shaft bearing 48*a*. Intermediate shaft bearing 48*a* is preferably fixed by a press fit in bearing receptacle 52*a*. Fan wheel 38*a* and at least intermediate shaft bearing 48*a* and/or intermediate shaft 18*a* preferably at least partially overlap in axial direction 40*a*.

Figure 3:
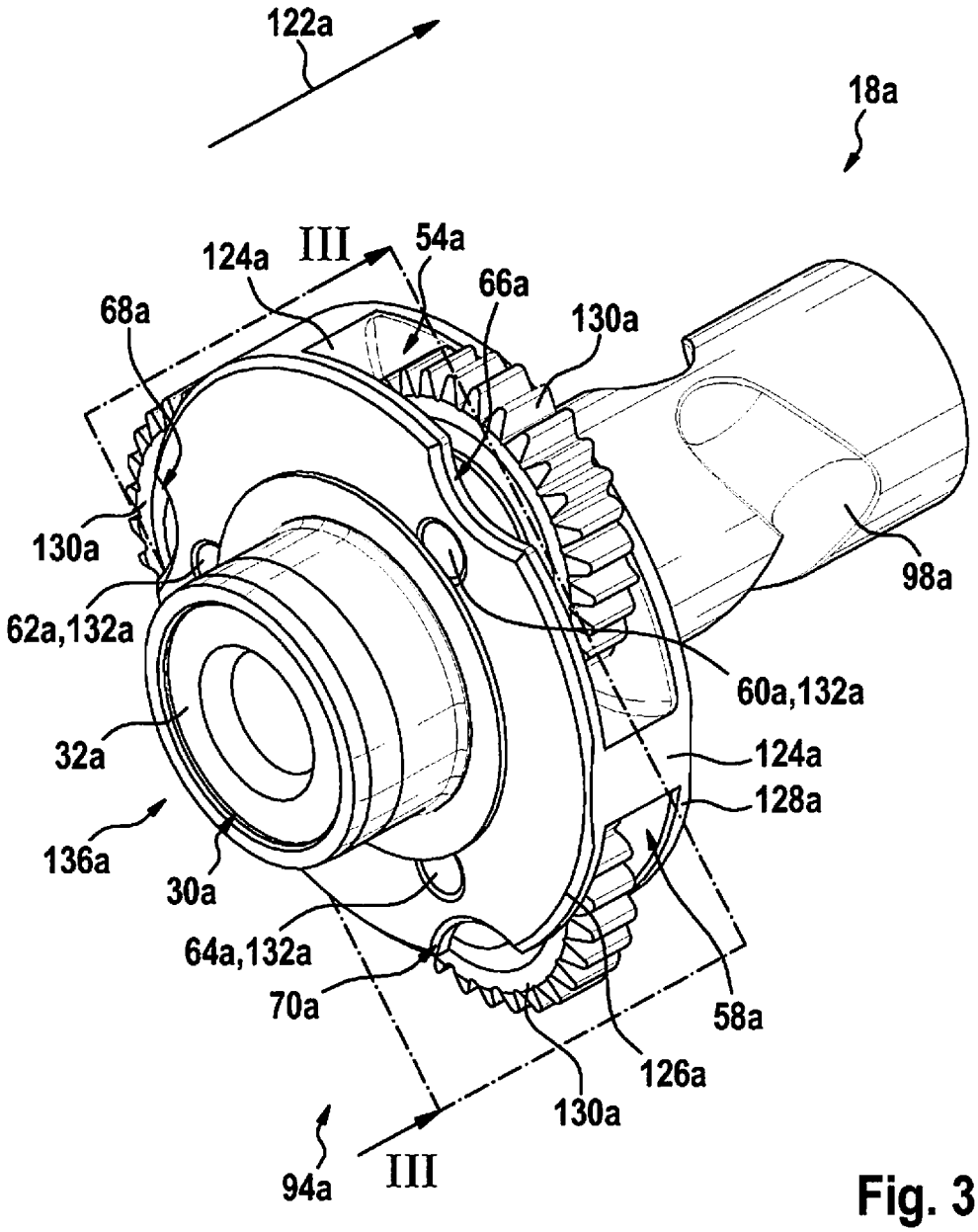
FIG. 3 shows an intermediate shaft of the hand-held power-tool device from FIG. 2 in a perspective view.
Figure 4:
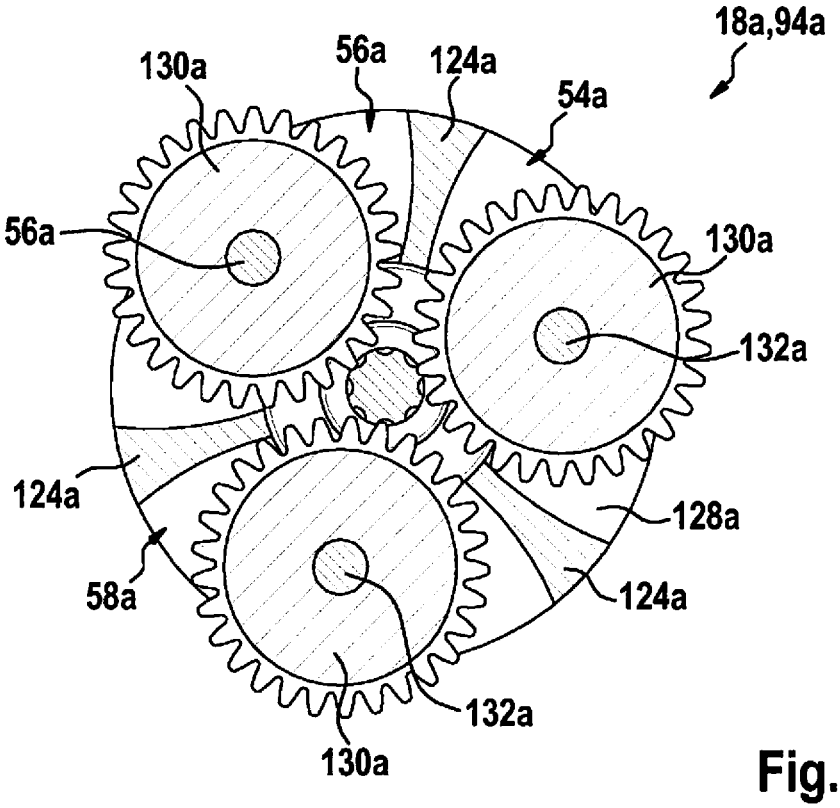
FIG. 4 shows a sectional view of the intermediate shaft from FIG. 3.

FIG. 3 shows intermediate shaft 18*a* in a perspective view. FIG. 4 shows intermediate shaft 18*a* in a sectional view along sectional plane Intermediate shaft 18*a* is designed as a planet wheel carrier 94*a* of planetary gear 50*a*. Intermediate shaft 18*a* includes a plurality of planet wheel receptacles 54*a*, 56*a*, 58*a* and planet wheel bearing points 60*a*, 62*a*, 64*a* situated in the circumferential direction. One planet wheel 130*a*, which is rotatably mounted with the aid of a pin 132*a*, is situated in each planet wheel receptacle 54*a*, 56*a*, 58*a*. Intermediate shaft 18*a* includes at least one material recess 66*a*, 68*a*, 70*a* on its outer circumference at least in the area of at least one planet wheel bearing point 60*a*, 62*a*, 64*a*. A number of material recesses 66*a*, 68*a*, 70*a* corresponds to a number of planet wheel receptacles 54*a*, 56*a*, 58*a*. Precisely one material recess 66*a*, 68*a*, 70*a* is associated with each planet wheel receptacle 54*a*, 56*a*, 58*a*. Intermediate shaft 18*a* includes three planet wheel receptacles 54*a*, 56*a*, 58*a*, each having one planet wheel bearing point 60*a*, 62*a*, 64*a*. Planet wheel bearing points 60*a*, 62*a*, 64*a* are situated offset by at least essentially 120° in relation to one another in each case in the circumferential direction on intermediate shaft 18*a*. Planet wheel receptacles 54*a*, 56*a*, 58*a* are separated from one another by webs 124*a* extending radially in relation to a longitudinal extension direction 122*a* of intermediate shaft 18*a*. Viewed along longitudinal extension direction 122*a* of intermediate shaft 18*a*, planet wheel receptacles 54*a*, 56*a*, 58*a* are delimited by two disk-shaped wall elements 126*a*, 128*a*, which are situated at least essentially perpendicularly to longitudinal extension direction 122*a*. Wall elements 126*a*, 128*a* are at least essentially circular. Wall elements 126*a*, 128*a* are formed in one piece with intermediate shaft 18*a*. Material recesses 66*a*, 68*a*, 70*a* are at least essentially in the form of circular segments. Planet wheel receptacles 54*a*, 56*a*, 58*a* are at least essentially in the form of cylinder segments. Material recesses 66*a*, 68*a*, 70*a* are introduced into one of the wall elements 126*a*, 128*a*. Material recesses 66*a*, 68*a*, 70*a* are introduced into wall element 126*a*, which is situated in an installed state of intermediate shaft 18*a* in the direction of a drive unit 12*a*. Wall elements 126*a*, 128*a* have an at least essentially identical radius. Alternatively, one of wall elements 126*a*, 128*a* may have a shorter radius.

Figure 5:
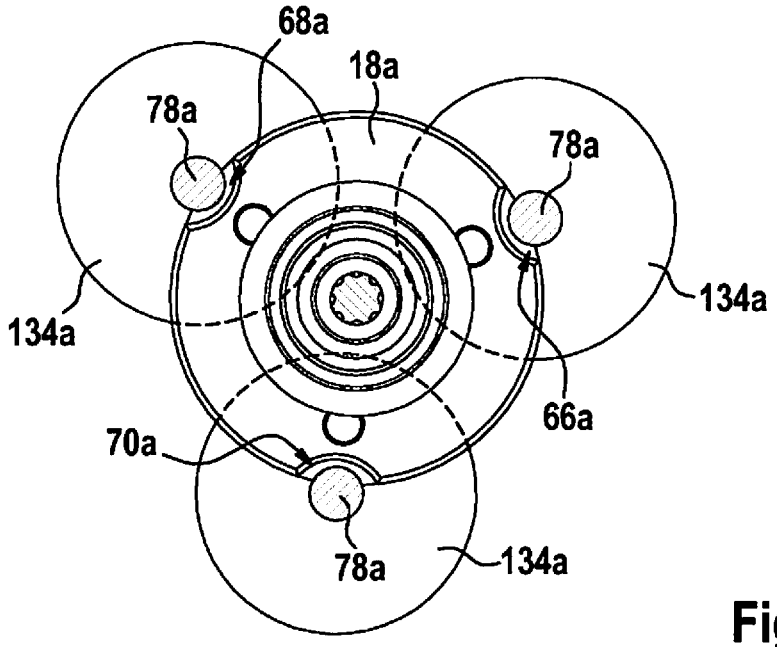
FIG. 5 shows a schematic view of an introduction of planet wheel receptacles into the intermediate shaft.

Material recesses 66*a*, 68*a*, 70*a* are provided during manufacturing of intermediate shaft 18*a* for at least temporary and at least partial accommodation of a milling head spindle 78*a* (cf. FIG. 5). Planet wheel receptacles 54*a*, 56*a*, 58*a* are introduced with the aid of a side milling cutter 134*a* into a blank of intermediate shaft 18*a*. During the introduction of planet wheel receptacles 54*a*, 56*a*, 58*a*, a milling head spindle 78*a* of side milling cutter 134*a* is at least partially inserted into a material recess 66*a*, 68*a*, 70*a*. Planet wheel receptacles 54*a*, 56*a*, 58*a* are introduced in a shared method step at least essentially simultaneously into intermediate shaft 18*a*, in particular with the aid of a plurality of identical side milling cutters 134*a*. Side milling cutters 134*a* are guided toward intermediate shaft 18*a* in such a way that milling head spindles 78*a* extend at least essentially parallel to a longitudinal extension direction 122*a* of intermediate shaft 18*a* at every point in time.

Figure 6:
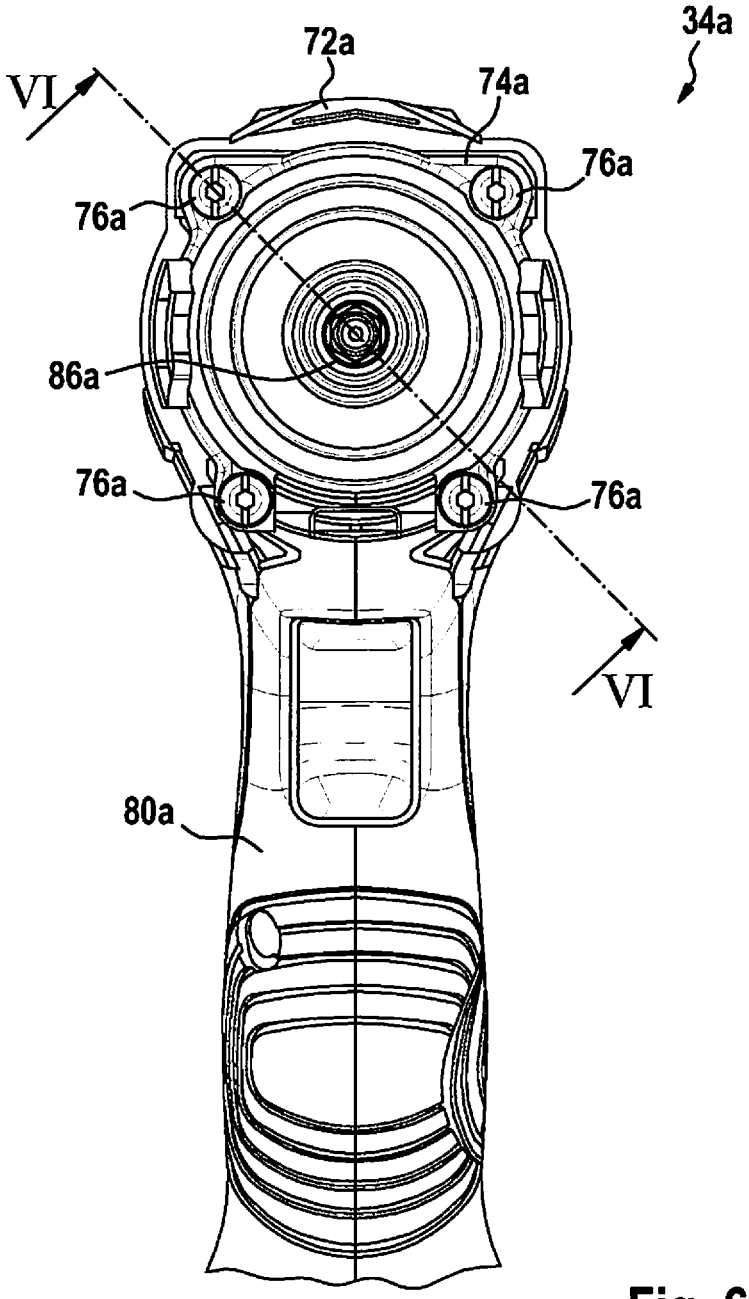
FIG. 6 shows the hand-held power tool in a frontal view.
Figure 7:
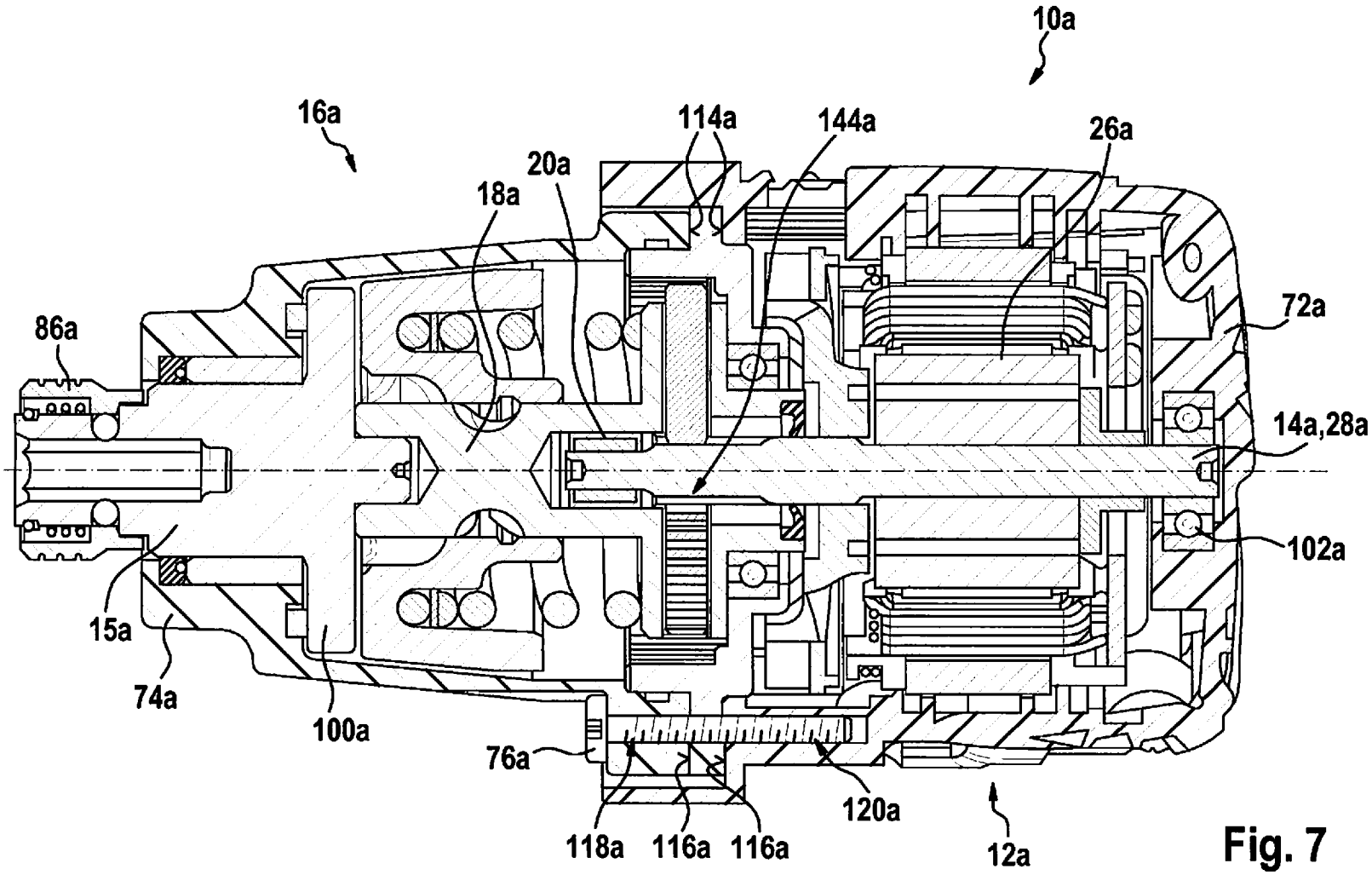
FIG. 7 shows a sectional view of the hand-held power tool.

FIG. 6 shows hand-held power tool 34*a* in a frontal view. FIG. 7 shows a sectional view of hand-held power tool 34*a* along sectional line VI-VI. Annulus gear 46*a* of planetary gear 50*a* is clamped between drive housing 72*a* and striking mechanism housing 74*a*. Drive housing 72*a* and striking mechanism housing 74*a* include a clamping surface 114*a*, each of which rests in an installed state from opposing sides on at least one surface 116*a* of annulus gear 46*a* and which each exert a clamping force on annulus gear 46*a*. Annulus gear 46*a* is fixed with the aid of at least one screw element 76*a*, preferably with the aid of at least one screw, on drive housing 72*a*. Annulus gear 46*a* is fixed using four screw elements 76*a*, for example. Annulus gear 46*a* includes recesses 118*a* on an outer circumference which are provided for passing through screw elements 76*a*. Drive housing 72*a* includes a number of threaded recesses 120*a*, which include a thread corresponding to a thread of screw elements 76*a*, corresponding to the number of screw elements 76*a*. Drive housing 72*a*, striking mechanism housing 74*a*, and annulus gear 46*a* are connected to one another in an installed state with the aid of screw elements 76*a*, annulus gear 46*a* being situated between drive housing 72*a* and striking mechanism housing 74*a*. Alternatively or additionally, annulus gear 46*a* may be fixed with the aid of at least one screw element 76*a* on striking mechanism housing 74*a*.

Figure 8:
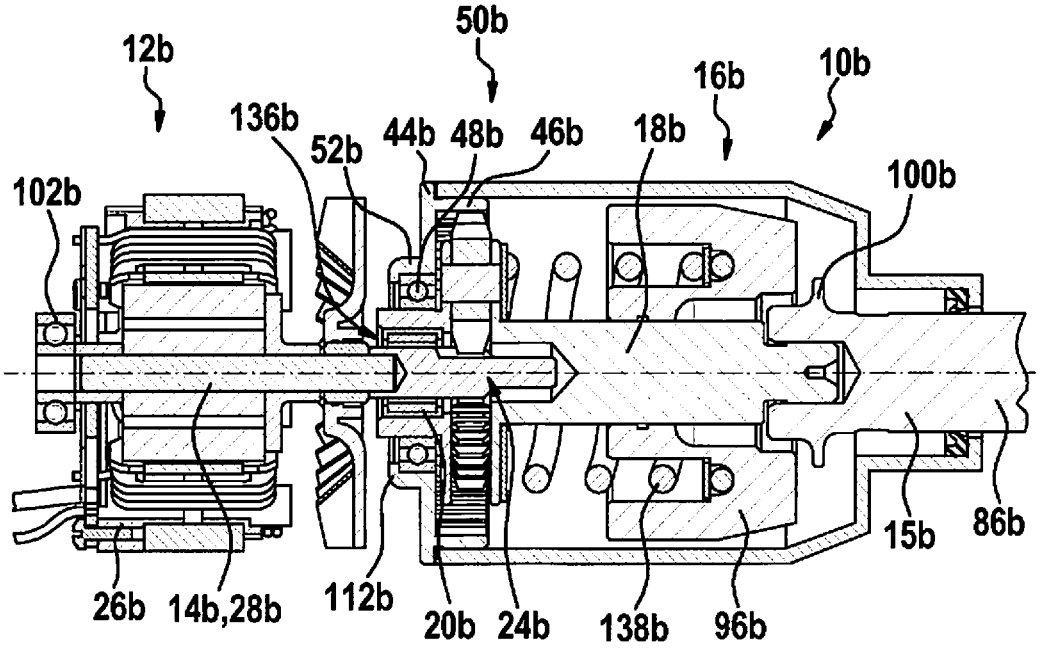
FIG. 8 shows a sectional view of an alternative hand-held power-tool device.
Figure 9:
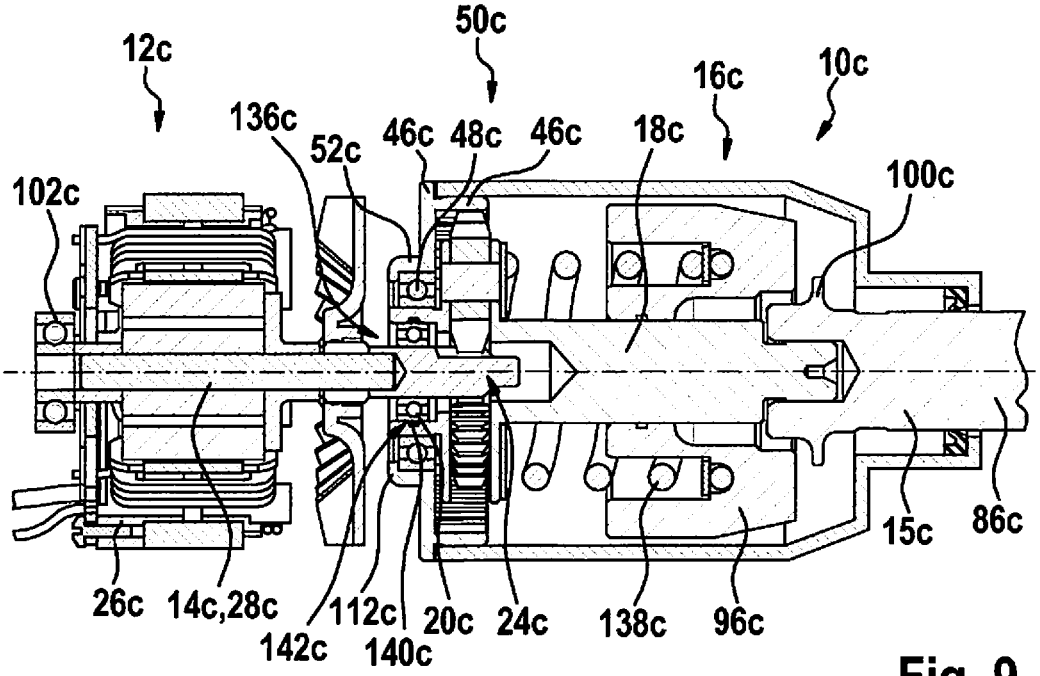
FIG. 9 shows a sectional view of another alternative hand-held power-tool device.

Another exemplary embodiment of the present invention is shown in FIGS. 8 and 9. The following descriptions and the drawings are essentially restricted to the differences between the exemplary embodiments, reference also basically being able to be made to the drawings and/or the description of the other exemplary embodiments, in particular of FIGS. 1 through 7, with respect to identically labeled components, in particular with respect to components having identical reference numerals. To differentiate the exemplary embodiments, the letter a is appended to the reference numerals of the exemplary embodiment in FIGS. 1 through 7. Letter a is replaced by letters b to c in the exemplary embodiments of FIGS. 8 and 9.

FIG. 8 shows an alternative embodiment of hand-held power-tool device 10*b* in a sectional view. Hand-held power-tool device 10*b* includes a drive unit 12*b* and a rotary striking mechanism 16*b* including a planetary gear 50*b*. Drive unit 12*b* includes a housing-free electric motor 26*b*, which is provided for converting electrical energy into rotational energy. Electric motor 26*b* is designed as an open-frame motor. Furthermore, drive unit 12*b* includes a driveshaft 14*b*, which is provided for transmitting the rotational energy to rotary striking mechanism 16*b*. Driveshaft 14*b* is partially formed by an armature shaft 28*b* of housing-free electric motor 26*b*.

Rotary striking mechanism 16*b* includes an intermediate shaft 18*b*, which is oriented at least essentially flush with respect to driveshaft 14*b*. Furthermore, hand-held power-tool device 10*b* includes at least one bearing 20*b* for mounting driveshaft 14*b*. Driveshaft 14*b* is at least partially mounted inside intermediate shaft 18*b*. Intermediate shaft 18*b* includes a receptacle recess 24*b*, which is provided to at least partially accommodate driveshaft 14*b*. Bearing 20*b* is situated directly at an insertion opening 136*b* of receptacle recess 24*b* of intermediate shaft 18*b*, which is provided for inserting driveshaft 14*b* into intermediate shaft 18*b*. Bearing 20*b* for mounting driveshaft 14*b* is situated on a side of planetary gear 50*b* facing toward drive unit 12*b*. Bearing 20*b* is designed as a roller bearing.

FIG. 9 shows another alternative embodiment of hand-held power-tool device 10*c* in a sectional view. Hand-held power-tool device 10*c* includes a drive unit 12*c* and a rotary striking mechanism 16*c* including a planetary gear 50*c*. Drive unit 12*c* includes a housing-free electric motor 26*c*, which is provided for converting electrical energy into rotational energy. Electric motor 26*c* is designed as an open-frame motor. Furthermore, drive unit 12*c* includes a driveshaft 14*c*, which is provided for transmitting the rotational energy to rotary striking mechanism 16*c*. Driveshaft 14*c* is partially formed by an armature shaft 28*c* of housing-free electric motor 26*c*.

Rotary striking mechanism 16*c* includes an intermediate shaft 18*c*, which is oriented at least essentially flush with respect to driveshaft 14*c*. Furthermore, hand-held power-tool device 10*c* includes at least one bearing 20*c* for mounting driveshaft 14*c*. Driveshaft 14*c* is at least partially mounted inside intermediate shaft 18*c*. Intermediate shaft 18*c* includes a receptacle recess 24*c*, which is provided for at least partially accommodating driveshaft 14*c*. Bearing 20*c* is situated directly at an insertion opening 136*c* of receptacle recess 24*c* of intermediate shaft 18*c*, which is provided for inserting driveshaft 14*c* into intermediate shaft 18*c*. Bearing 20*c* for mounting driveshaft 14*c* is situated on a side of planetary gear 50*c* facing toward drive unit 12*c*. Bearing 20*c* is designed as a ball bearing. Furthermore, hand-held power-tool device 10*c* includes a sealing ring 140*c*, which encloses bearing 20*c* in the circumferential direction and which is situated between bearing 20*c* and an internal diameter receptacle recess 24*c* of intermediate shaft 18*c*. Intermediate shaft 18*c* includes a groove 142*c*, which is provided for accommodating sealing ring 140*c*.

What is claimed is:

1. A hand-held power-tool device, comprising:

a drive unit that includes at least one driveshaft;

at least one rotary striking mechanism that includes at least one intermediate shaft aligned at least flush with respect to the driveshaft, wherein the rotary striking mechanism includes a striking mechanism cover, wherein the striking mechanism cover is situated between the drive unit and a planetary gear;

at least one bearing for mounting the driveshaft, wherein the bearing is situated at least partially in a plane that intersects the intermediate shaft and extends at least essentially perpendicularly with respect to the intermediate shaft, and an intermediate shaft bearing for mounting the intermediate shaft, wherein the intermediate shaft bearing is designed as a radial bearing and configured for rotatably mounting the intermediate shaft in the striking mechanism cover, wherein the intermediate shaft includes at least one sealing element receptacle, wherein the intermediate shaft includes at least one sealing element situated in the sealing element receptacle.

2. The hand-held power-tool device as recited in claim 1, wherein the driveshaft is mounted at least partially inside the intermediate shaft.

3. The hand-held power-tool device as recited in claim 1, wherein the intermediate shaft includes at least one receptacle recess for at least partially accommodating the driveshaft.

4. The hand-held power-tool device as recited in claim 3, wherein the bearing is situated at least partially inside the receptacle recess.

5. The hand-held power-tool device as recited in claim 1, wherein the bearing is an antifriction bearing.

6. The hand-held power-tool device as recited in claim 1, wherein the drive unit includes at least one housing-free electric motor.

7. The hand-held power-tool device as recited in claim 6, wherein the driveshaft is at least partially formed by an armature shaft of the housing-free electric motor.

8. The hand-held power-tool device as recited in claim 1, wherein a length of the hand-held power-tool device is at most 200 mm.

9. The hand-held power-tool device as recited in claim 1, wherein a length of the hand-held power-tool device is at most 160 mm.

10. The hand-held power-tool device as recited in claim 1, wherein a length of the hand-held power-tool device is at most 140 mm.

11. The hand-held power-tool device as recited in claim 1, wherein a length of the hand-held power-tool device is at most 130 mm.

12. The hand-held power-tool as recited in claim 1, wherein the striking mechanism cover includes a pass-through recess, which is provided for at least partially passing through at least the driveshaft.

13. The hand-held power-tool as recited in claim 12, wherein the intermediate shaft bearing is situated directly at the pass-through recess of the striking mechanism cover.

14. The hand-held power-tool as recited in claim 12, wherein the bearing receptacle is situated in the area of the pass-through recess of the striking mechanism cover.

15. The hand-held power-tool as recited in claim 1, wherein the striking mechanism cover includes at least one bearing receptacle, which is provided for accommodating the intermediate shaft bearing.

16. The hand-held power-tool as recited in claim 15, wherein the bearing receptacle is situated in the area of the pass-through recess of the striking mechanism cover.

17. The hand-held power-tool as recited in claim 15, wherein the bearing receptacle is formed in one piece with the striking mechanism cover.

18. A hand-held power tool, comprising:

at least one handheld power-tool device that includes:

a drive unit that includes at least one driveshaft, at least one rotary striking mechanism that includes at least one intermediate shaft aligned at least flush with respect to the driveshaft, wherein the rotary striking mechanism includes a striking mechanism cover, wherein the striking mechanism cover is situated between the drive unit and a planetary gear; and at least one bearing for mounting the driveshaft, wherein the bearing is situated at least partially in a plane that intersects the intermediate shaft and extends at least essentially perpendicularly with respect to the intermediate shaft; and an intermediate shaft bearing for mounting the intermediate shaft, wherein the intermediate shaft bearing is designed as a radial bearing and configured for rotatably mounting the intermediate shaft in the striking mechanism cover, wherein the intermediate shaft includes at least one sealing element receptacle, wherein the intermediate shaft includes at least one sealing element situated in the sealing element receptacle.

* * * * *